US005203492A

United States Patent [19]

Schellenberg

[11] Patent Number: 5,203,492

[45] Date of Patent: Apr. 20, 1993

[54] PACKING CONTAINER

[75] Inventor: Walter Schellenberg, Diepoldsau, Switzerland

[73] Assignee: Rundpack AG, Diepoldsau, Switzerland

[21] Appl. No.: 758,765

[22] Filed: Sep. 12, 1991

[30] Foreign Application Priority Data

Sep. 12, 1990 [CH] Switzerland ..... 02954/90

[51] Int. Cl.[5] ..... B65D 3/28

[52] U.S. Cl. ..... 229/4.5; 229/5.5; 220/678

[58] Field of Search ..... 220/678, 680, 403; 229/4.5, 5.5, 201, 202, 203

[56] References Cited

U.S. PATENT DOCUMENTS

| | | | |
|---|---|---|---|
| 2,811,455 | 10/1957 | Erekson | 229/5.5 |
| 2,906,180 | 9/1959 | Bracht | 229/4.5 |
| 3,146,930 | 9/1964 | Elam | 229/4.5 |
| 3,366,493 | 1/1968 | Stump | 229/203 |
| 3,379,358 | 4/1968 | Cvacho | 229/4.5 |
| 3,506,183 | 4/1970 | Turpin et al. | 229/4.5 |
| 3,581,972 | 6/1971 | Buchner et al. | 229/4.5 |
| 3,981,433 | 9/1976 | Thornhill et al. | 229/202 |
| 4,051,992 | 10/1977 | Bergstein | 229/4.5 |
| 4,163,517 | 8/1979 | Kappler et al. | 229/4.5 |
| 4,382,525 | 5/1983 | Kobayashi et al. | 220/678 |

*Primary Examiner*—Allan N. Shoap
*Assistant Examiner*—Christopher M. McDonald
*Attorney, Agent, or Firm*—Ladas & Parry

[57] ABSTRACT

For a separate waste disposal of the aluminum foil inner coating (9) of a packing container produced in a winding process, the overlapping foil edges (16, 17) are only glued together at a distance from a foil outer edge (18). The unglued overlapping foil edge (21) makes it possible to peel the inner coating (9) from the cardboard body, after removing the bottom diaphragm of the packing container. The peeling movement starts on removing the bottom diaphragm, in that its rim is glued to the unglued, overlapping foil edge. A gripping tab is provided on the bottom diaphragm to permit the removal thereof.

22 Claims, 3 Drawing Sheets

PACKING CONTAINER

BACKGROUND OF THE INVENTION

The invention relates to a packing container with a container body, which is closed at its one end by a bottom diaphragm and at its other end by a lid diaphragm, the container body having an inner coating of a material which is of a different type from that of its outer coating and is of the same type as the material of the bottom diaphragm and said inner coating extends helically with overlapping edges on the container body.

A container of this type is e.g. known from CH-A-666 458 (U.S. Pat. No. 4,632,298). Its body is produced in a winding process, in that strip-like material for the layers is helically wound to a tube on a mandrel, as is e.g. described in GB-B-947,454.

SUMMARY OF THE INVENTION

The problem of the invention is to provide a packing container of the aforementioned type, whose inner coating made from the different type of material, e.g. aluminum can be detached in a simple manner for separate waste disposal with respect to the outer coating of the container body. According to the invention this problem is solved in that the rim of the bottom diaphragm is connected to the foil strip of the inner coating and the overlapping edges of said foil strip are superimposed in contact-free manner at least in an outer marginal area, the bottom diaphragm carrying a grip, so that on tearing out the bottom diaphragm the foil strip of the inner coating is detached from the outer coating with an area of the overlapping edge engaging in contact-free manner on the underlying layer edge and is also torn out for separate waste disposal.

The tearing out of the inner coating takes place in a particularly simple manner if the bottom diaphragm is provided at the end of the container body at which the edge of the foil strip overlapping towards the inner area passes out in an acute-angled manner, the rim of the bottom diaphragm being connected at least to the tapering end of the foil strip of the inner layer overlapping towards the inner area. Further advantageous embodiments of the inventive packing container form the subject matter of dependent claims and are described hereinafter relative to the drawings. The drawings have different scales and the thickness of the material layers is not proportional and in particular not to the container size.

DETAILED DESCRIPTION OF THE PREFERRED EMBODIMENTS

Figure 1:
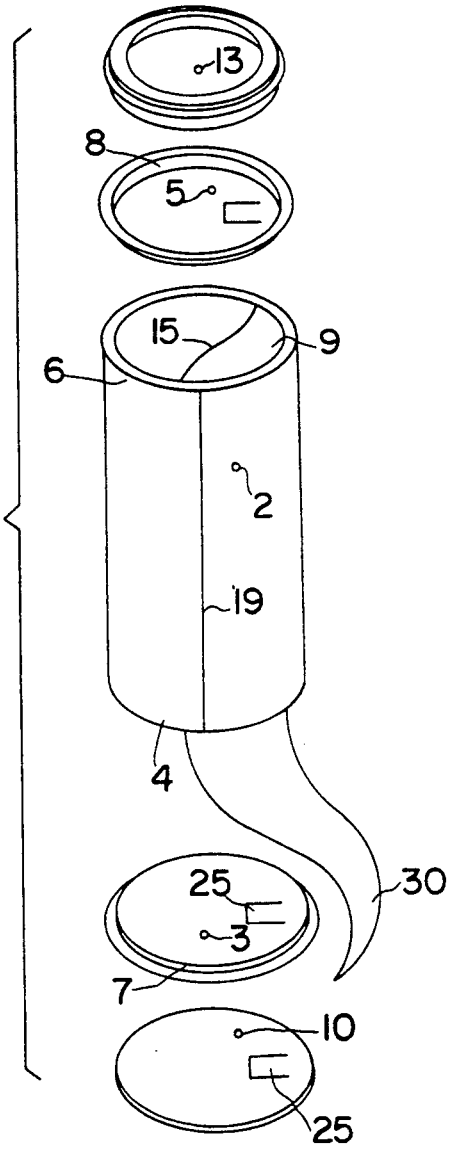
FIG. 1 is an exploded view of a packing container.

In accordance with the represented embodiments, the packing container e.g. has a circular cylindrical container body 2 formed by cutting from a wound tubular body. A bottom diaphragm 3 closes its one end 4 and a lid diaphragm 5 its other end 6. Both diaphragms 3, 5 are produced by deep drawing from an aluminum foil with a cylindrical rim 7, 8, which is connected to the inner coating 9 of the container body 2 by hot sealing. The diaphragm bottom 3 is protected by a reinforcing cardboard disk 10, e.g. of corrugated cardboard, which is enclosed on its circumference by the cylindrical rim 7 of the bottom diaphragm 3 and is held there by the slightly inwardly pressed marginal bead 12 of the container body 2. The lid diaphragm 5 is protected by a saucer-shaped lid 13, which can be used for resealing the packing container after removing the lid diaphragm 5 along a not shown predetermined separation line. The outside of the cardboard body 2 is surrounded by a label 19 serving as a decoration and inscription carrier.

Figure 3:
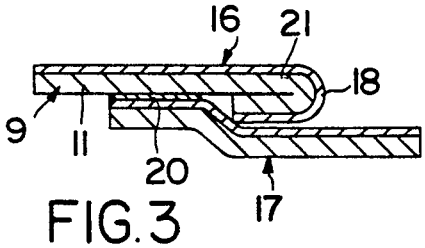
FIGS. 3 to 5 show different embodiments of the overlapping area of the inner coating to be separated.
Figure 4:
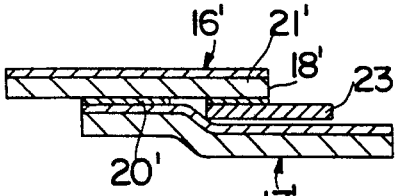
Figure 5:
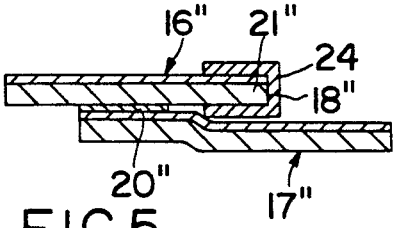

The inner aluminium coating 9 of the container body 2 includes a paper carrier layer 11. Just as its outer layer 14 is wound from a much thiker, strip-like cardboard material, the inner coating is helically wound from a foil strip so that the adjacent edges of the strip extending along a helical line 15 overlap as overlapping edges 16, 17 (as shown in FIG. 3) or 16', 17' (as shown in FIG. 4) or 16'', 17'' (as shown in FIGS. 5). These overlapping edges are glued together to form a gastight inner coating 9. However, according to the invention the gluing is only provided along a narrow gluing strip 20, 20', 20'' spaced from the marginal edge 18, 18', 18'' of the foil strip, so that an outer marginal area 21, 21', 21'' of the edge overlapping the container inside rests in a contact-free manner upon the underlying surface. Thus, on tearing out the bottom diaphragm 3 which is connected to the inner coating 9 of the container body 2, said marginal area 21, 21', 21'' of the bottom diaphragm 3 initially follows and by a peeling movement subsequently destroys the gluing strip 20, 20', 20''. Thus, the entire inner coating 9 in the form of its foil strip can be easily drawn out of the container body 2.

Figure 2:
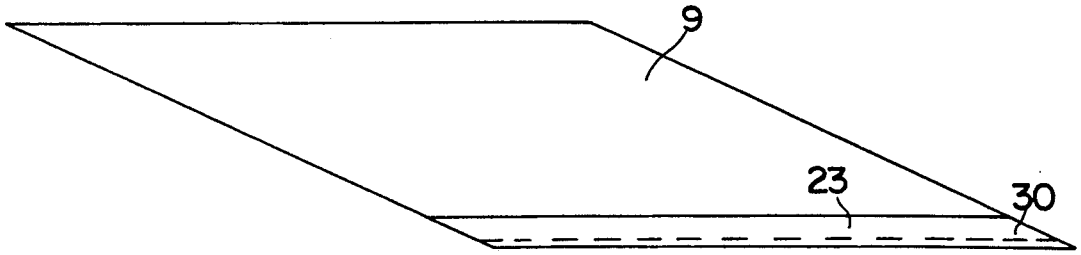
FIG. 2 is a plan view of the foil strip of the inner coating in a developed representation.
Figure 6:
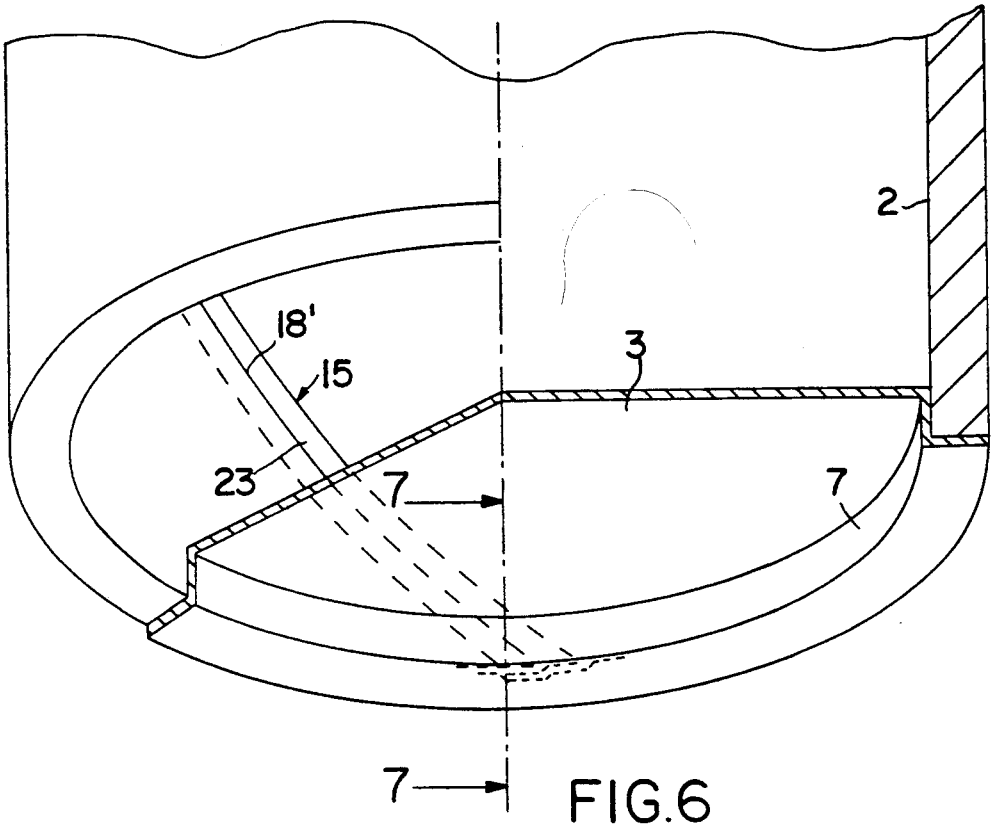
FIG. 6 is a perspective, part sectional view of the packing container area having the bottom diaphragm.
Figure 7:
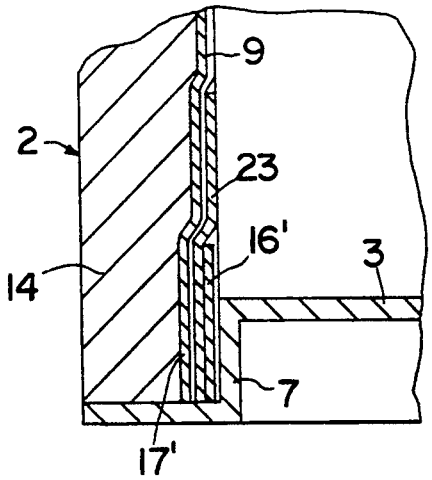
FIG. 7 is a partial cross-section along line 7–7 of FIG. 6, in the vicinity of the bottom diaphragm rim.
Figure 8:
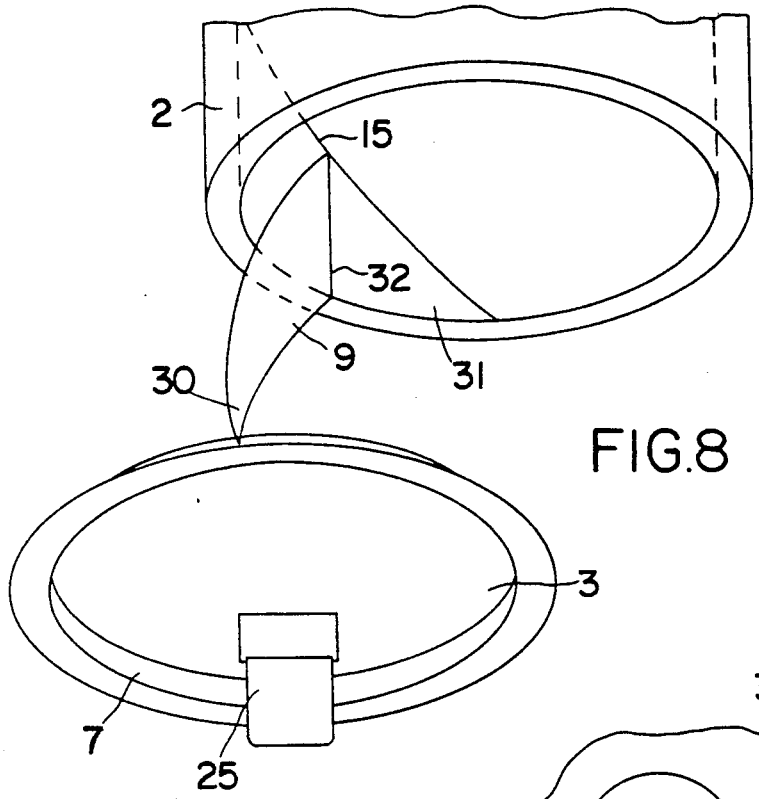
FIG. 8 is a perspective view of the lower part of a packing container after partly separating the inner coating.

FIG. 8 shows the starting phase of the peeling off movement for the inner coating 9. Detachment firstly takes place with the bottom diaphragm 3 of the tapering tip region 30 of the inner coating 9 engaging in unsealed and unbonded manner on the container body 2 and the peeling movement then continues along the advancing peeling line 32 and the inner cardboard surface 31 of the container body 2 is increasingly exposed until the foil portion of the inner coating 9 with the form shown in FIG. 2 is completely removed, so that it can be disposed of as aluminium waste.

In order to reliably prevent during the tearing out of the foil strip of the inner coating 9 that the latter does not laterally tear and therefore tear off, so that part of the inner coating is left behind on the container body, the marginal area 21, 21', 21'' of the foil strip of the inner coating 9 is reinforced in accordance with the embodiments of FIGS. 3 to 5. For this purpose, according to FIG. 3 the marginal area 21 is folded inwards towards the underlying rim 17.

According to FIG. 4 an additional tear-off strip 23 is inserted between the overlapping edges 16', 17' during winding and bonded to the inside of the marginal area 16'. This tear-off strip 23 extends through its helical configuration up to the bottom diaphragm 3 and its end is bonded thereto, so that it initiates the separation of the inner coating 9. In the embodiment according to FIG. 5 the marginal area 21'' of the foil strip of the inner coating is surrounded by a reinforcing strip 24. It is not necessary to tear out the inner coating with the bottom diaphragm 3, because the pointed tip region 30 of the inner coating 9 drawn upwards during the release of the bottom diaphragm 3 can be used for further tearing out by hand. The possibility of tearing out the inner coating 9 can be rendered visible by colouring the tear-off strip 23, the reinforcing strip 24 or the unconnected overlapping edge 21 of the inner coating 9 or by inscriptions provided there.

Figure 9:
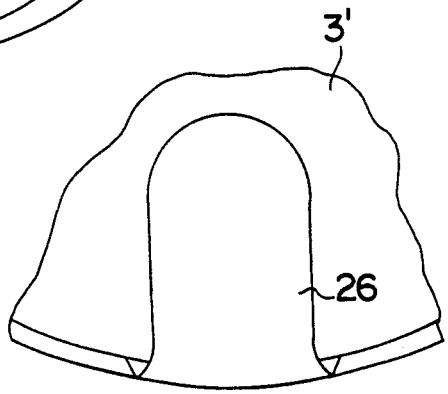
FIG. 9 is a partial view of a bottom diaphragm in the vicinity of a gripping tab.
Figure 10:
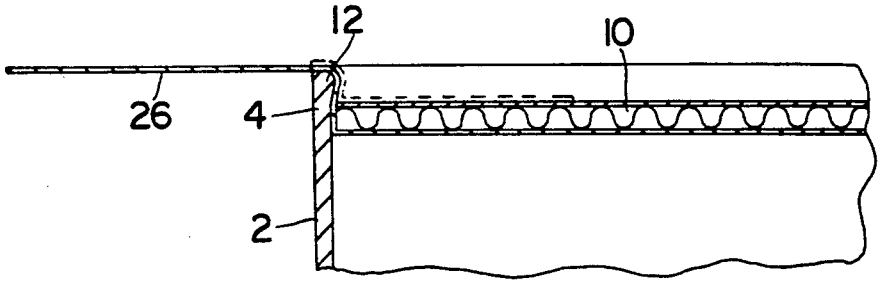
FIG. 10 is the bottom diaphragm fixed to the container bottom with an outwardly folded or opened gripping tab.

The tearing out of the bottom diaphragm 3 takes place by pulling a gripping tab 25, 26 which, according to FIGS. 1 and 8 is shaped onto the diaphragm part covering the container cross-section and according to FIGS. 9 and 10 is shaped externally onto the diaphragm rim. On tearing out the bottom diaphragm 3 by pulling the gripping tab 25 or 26, the cardboard disk 10 is also pulled out. In the embodiment according to FIGS. 1 and 8 the gripping tab 25 is provided at the same point in the cardboard disk 10, so that both cover one another.

What is claimed is:

1. A packing container with a container body, which is closed at one end (4) by a bottom diaphragm (3) and at its other end (6) by a lid diaphragm (5), the container body (2) having an inner coating (9) of a material which is of a different type from that of an outer coating (14) and is of the same type as the material of the bottom diaphragm (3) and said inner coating (9) extending helically with overlapping edges (16,17; 16',17'; 16'',17'') on the container body (2), the bottom diaphragm (3) having a rim which is connected to a strip of the inner coating (9) and the overlapping edges of said strip are superimposed in a contact-free manner at least in an outer marginal area (21,21',21''), the bottom diaphragm (3) carrying a grip, so that upon tearing out the bottom diaphragm (3) the strip of the inner coating is detached from the outer coating for separate waste disposal.

2. A packing container according to claim 1, wherein the bottom diaphragm (3) is provided at the end of the container body (2) at which the strip edge (21, 21', 21'') overlapping towards an inner area passes out in an acute-angled manner, the rim of the bottom diaphragm (3) being connected at least to a tapering end (30) of the strip of the inner coating (9) overlapping towards the inner area.

3. A packing container according to claim 1, wherein the overlapping edges (16,17; 16',17'; 16'',17'') of the strip of the inner coating (9) are glued or sealed together at a distance from a terminal edge (18,18',18''), so that the release of the strip of the inner coating (9) takes place by a peeling movement along the helical line which commences at an unbonded or unsealed outer overlapping edge (21,21',21'').

4. A packing container according to claim 1, wherein at least one layer of the strip of the inner coating (9) is made of aluminium.

5. A packing container according to claim 1, wherein the bottom diaphragm (3) has a cylindrical rim (7) engaging on the inner coating (9) of the container body (2) and said rim surrounds a reinforcing disk (10) engaging externally on the bottom diaphragm (3).

6. A packing container according to claim 1, wherein the bottom diaphragm (3) is firmly connected along its entire circumference to the inner coating (9) of the container body (2) by bonding or hot sealing, said connection forming a predetermined breaking line.

7. A packing container according to claim 3, wherein the inside of the outer overlapping edge (21') not bonded or sealed to the adjacent strip is bonded to a narrow tear-off strip (23), so that the latter extends along the helical, lateral boundary of the strip of the inner coating (9).

8. A packing container according to claim 3, wherein the outer overlapping edge (21'') not connected to the adjacent strip is surrounded by a reinforcing member (24).

9. A packing container according to claim 3, wherein the outer overlapping edge (21) not connected to the adjacent strip is folded over towards the adjacent layer for forming a reinforcing edge.

10. A packing container according to claim 1, wherein the grip of the bottom diaphragm (3) is formed by a gripping tab (25, 26) surrounded by the diaphragm rim or laterally shaped onto the latter.

11. A packing container according to claim 5, wherein the grip of the bottom diaphragm (3) is formed by a finger grip opening in the reinforcing disk (10).

12. A packing container body comprising:

a body and an inner liner made of a material different than said body, said liner extending helically with overlapping edges in said body, said body having a diaphragm attached to an end of said body, said diaphragm having a rim which is connected to said liner, said overlapping edges being at least temporarily in contact with each other in a region which is spaced a predetermined distance from an overlapping edge facing an interior of the container body to facilitate the removal of said liner from said container body when said diaphragm is torn out for waste disposal.

13. A packing container as claimed in claim 12, wherein said liner extends in said body in an acute-angled manner, said rim being connected at least to a tapering end of said liner.

14. A packing container as claimed in claim 12, wherein at least one layer of said liner is made of aluminium.

15. A packing container as claimed in claim 12, wherein said diaphragm has a reinforcing disk disposed within said rim.

16. A packing container as claimed in claim 15, wherein the diaphragm has a finger grip which opens in the reinforcing disk.

17. A packing container as claimed in claim 12, wherein the diaphragm is firmly connected along its entire circumference to said liner by bonding or sealing, said connection having a predetermined breaking line.

18. A packing container as claimed in claim 12, wherein the inside of the overlapping edge facing the interior of the container body is attached to a narrow tear-off strip, so that said strip extends along the helical, lateral boundary of said liner.

19. A packing container as claimed in claim 12, wherein the overlapping edge facing the interior of the container body is surrounded by a reinforcing member.

20. A packing container as claimed in claim 12, wherein the overlapping edge facing the interior of the container body is folded over towards the adjacent layer to form a reinforcing edge.

21. A packing container as claimed in claim 12, wherein the diaphragm has a gripping tab which is provided on a plane of the diaphragm.

22. A packing container as claimed in claim 12, wherein the diaphragm has a gripping tab which is laterally shaped onto the rim.

* * * * *